US007023419B2

(12) United States Patent
Park

(10) Patent No.: US 7,023,419 B2
(45) Date of Patent: Apr. 4, 2006

(54) LIQUID CRYSTAL DISPLAY DEVICE

(75) Inventor: Joon Ha Park, Taegu-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 87 days.

(21) Appl. No.: 10/029,040

(22) Filed: Dec. 28, 2001

(65) Prior Publication Data

US 2002/0084965 A1 Jul. 4, 2002

(30) Foreign Application Priority Data

Dec. 30, 2000 (KR) ..... 2000-86846

(51) Int. Cl.
*G09G 3/36* (2006.01)

(52) U.S. Cl. ..... 345/103; 345/100

(58) Field of Classification Search ..... 345/87–100, 345/103, 204; 349/139
See application file for complete search history.

(56) References Cited

U.S. PATENT DOCUMENTS 5,777,591 A * 7/1998 Katoh et al. ..... 345/92
5,907,314 A * 5/1999 Negishi et al. ..... 345/103
6,177,917 B1 * 1/2001 Koizumi et al. ..... 345/87
6,219,022 B1 * 4/2001 Yamazaki et al. ..... 345/103
6,229,516 B1 * 5/2001 Kim et al. ..... 345/103
6,545,655 B1 * 4/2003 Fujikawa ..... 345/87
6,624,801 B1 * 9/2003 Moriyama ..... 345/100
6,624,865 B1 * 9/2003 Edwards ..... 349/139

FOREIGN PATENT DOCUMENTS

EP 0315365 * 5/1989

* cited by examiner

*Primary Examiner*—Regina Liang
(74) *Attorney, Agent, or Firm*—Morgan, Lewis & Bockius LLP

(57) ABSTRACT

The specification and drawings describe and show embodiments of the present invention in a liquid crystal display device for maintaining a picture quality in divisional driving of a large-scale/high-resolution liquid crystal display panel. In the device, a liquid crystal display panel has a plurality of liquid crystal cells at the intersections between a plurality of data lines and gate lines and a plurality of thin film transistors driving the liquid crystal cells. A plurality of switching devices are provided at least one of at the data lines and the gate lines switching to either a divisional driving mode or a non-divisional driving mode. A controller supplies a signal to the switching devices. A control line is provided at the liquid crystal display panel and connected to the switching devices and the controller.

6 Claims, 4 Drawing Sheets

LIQUID CRYSTAL DISPLAY DEVICE

This application claims the benefit of Korean Application No. P2000-86846 filed on Dec. 30, 2000, which is hereby incorporated by reference.

BACKGROUND OF THE INVENTION

1. Field of the Invention

The present invention relates to a liquid crystal display, and more particularly, to a liquid crystal display device for maintaining a picture quality in a divisional driving mode for a large-scale/high-resolution liquid crystal display panel.

2. Discussion of the Related Art

Generally, a liquid crystal display (LCD) controls light transmittance of liquid crystal cells arranged in a matrix pattern in response to video signals, thereby displaying a picture corresponding to the video signals on the liquid crystal display panel.

To this end, the LCD includes an active area having liquid crystal cells arranged in an active matrix type and driving circuits for driving the liquid crystal cells at the active area. More specifically, the LCD includes upper and lower plates. A plurality of thin film transistors (TFT's) for switching the liquid crystal cells, driving circuits for driving the thin film transistors and signal lines connected between the driving circuits and the TFT's are mounted on the lower substrate. The upper plate is provided with color filters separated for each cell area by black matrix stripes in correspondence with the matrix liquid crystal cells and transparent electrodes coated on the color filters, and spacers provided between the upper and lower plates to maintain a constant cell gap. A liquid crystal is filled in a space defined between the upper and lower plates by the spacers.

Such an LCD is fabricated by separately preparing the upper plate and the lower plate. After the two plates are attached to each other, a liquid crystal is injected between the plates through a liquid crystal injection hole. Thereafter, the LCD is completed by coating the liquid crystal injection hole with a sealant and curing the sealant.

The driving circuits require a plurality of driving integrated circuits (D-IC) connected to a plurality of data lines and gate lines to apply data signals and a scanning signal to the data lines and the gate lines, respectively. As the LCD is capable of realizing a large scale and a high resolution, a display speed of the liquid crystal display panel becomes slow because the time required for allowing the D-IC to conduct all the TFT's is extended. For this reason, when a gate voltage level is set to be too high, a voltage drop occurs from a pixel due to a feed through phenomenon, upon turning off the gate voltage, thereby causing a more serious distortion in picture quality.

Accordingly, there is a demand for a divisional driving of the liquid crystal display panel to overcome the problem as discussed above.

In such a divisional driving method for the liquid crystal display panel, as shown in FIG. 1, each data lines of the panel is physically cut at the half point "A" in FIG. 1.

In FIG. 1, the conventional LCD includes TFT's provided at the intersections between a plurality of gate lines 7 and 9 and data lines 3 and 5, upper and lower source drive IC's (SD-IC) 2 and 4 for applying data signals to the data lines 3 and 5 physically divided into the upper side and the lower side. Left and right gate drive IC's (GD-IC) 6 and 8 applies scanning signals to the upper and lower gate lines 7 and 9 that are divided only based on a signal without a physical division.

The upper SD-IC 2 applies the data signals to the data lines 3 of the first divided panel positioned at the upper portion of the panel in which the data lines 3 and 5 are cut at the half point "A" of the panel. The lower SD-IC 4 applies the data signals to the data lines 5 of the second divided panel positioned at the lower portion of the panel in which the data lines 3 and 5 are cut at the half point "A" of the panel.

The left GD-IC 6 and the right GD-IC 8 apply scanning signal to the upper and lower gate lines 7 and 9 to turn on the TFT'S.

In the LCD, in order to display a picture on each pixel, data signals are applied from the upper and lower SD-IC 2 and 4 to the data lines 3 and 5. Scanning signals from the left and right GD-IC 6 and 8 are sequentially applied to the gate lines 7 and 9 crossing the data lines 3 and 5 to turn on the TFT's. Accordingly, the data signal is applied through source and drain electrodes of the TFT to the pixel electrode, thereby displaying a picture on each pixel.

The upper and lower data lines 3 and 5 are driven independently as shown in FIG. 2. Thus, upon implementing the images, a difference in the picture quality is caused between the first divided panel and the second divided panel. More specifically, the TFT's on the panel improve a sustaining characteristic of the data signals applied to the pixels with the aid of storage capacitors (not shown). Also, the TFT's stabilize a gray scale display and maintain pixel information while the pixels are in a non-selection interval.

The storage capacitors connected to the pixels of the first divided panel are connected to the pre-stage gate lines to charge applied voltages. On the other hand, the storage capacitors connected to the first pixels of the second divided panel cannot charge voltages from the pre-stage gate lines at the non-selection interval because no pre-stage gate line at the storage capacitors is caused by the vertical division. As a result, there is a difference in a picture quality between the first divided panel and the second divided panel.

Moreover, the conventional LCD has an additional problem in that a circuitry configuration becomes complicated since a frame memory should be used as a panel driving apparatus for a divisional driving.

SUMMARY OF THE INVENTION

Accordingly, the present invention is directed to a liquid crystal display device that substantially obviates one or more of problems due to limitations and disadvantages of the related art.

Another object of the present invention is to provide a liquid crystal display device for maintaining a picture quality in divisional driving of a large-scale/high-resolution liquid crystal display panel.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a liquid crystal display panel having a plurality of liquid crystal cells at each intersection between a plurality of data lines and gate lines and a plurality of thin film transistors driving the liquid crystal cells, a plurality of switching devices at least one of at the data lines and the gate lines switching to either a divisional driving mode or a non-divisional driving mode, a controller supplying a control signal to the switching devices to control the switching devices, and a control line connecting the switching devices and the controller.

In the liquid crystal display device, the switching devices include a plurality of first switching devices at the middle portion of the data lines, and a plurality of second switching devices at the middle portion of the gate lines.

In the liquid crystal display device, the control signal is either an on-selection signal for the divisional driving mode or an off-selection signal for the non-divisional driving mode.

In another aspect of the present invention, a liquid crystal display device includes a liquid crystal display panel having a plurality of liquid crystal cells at each intersection between a plurality of data lines and gate lines and a plurality of thin film transistors driving the liquid crystal cells, a plurality of switching devices at least one of at the data lines and the gate lines switching to either a divisional driving mode or a non-divisional driving mode, a controller supplying a control signal to the switching devices to control the switching devices, a control line connecting the switching devices and the controller, first and second source drivers applying a data signal to the data lines, first and second gate drivers applying a gate signal to the gate lines, and a timing controller applying a control signal to the source driver and the gate driver.

In the liquid crystal display device, the switching devices include a plurality of first switching devices at the middle portion of the data lines, and a plurality of second switching devices at the middle portion of the gate lines.

In the liquid crystal display device, the control signal is either an on-selection signal of the divisional driving mode or an off-selection signal of the non-divisional driving mode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 1:
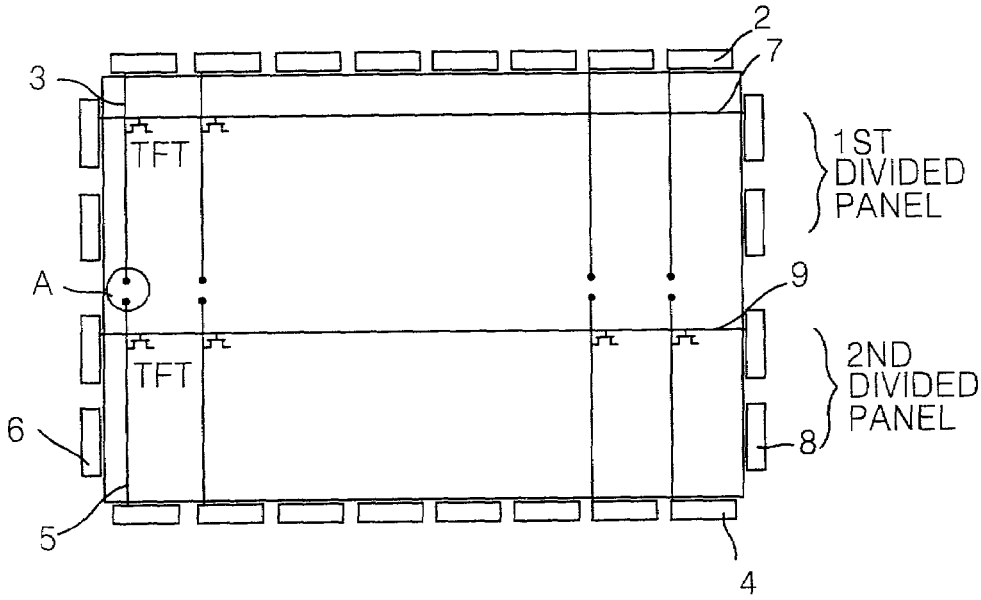
FIG.1 CONVENTIONAL ART
FIG. 1 is a schematic plan view for showing a divisional driving scheme in a conventional liquid crystal display panel.
Figure 2:
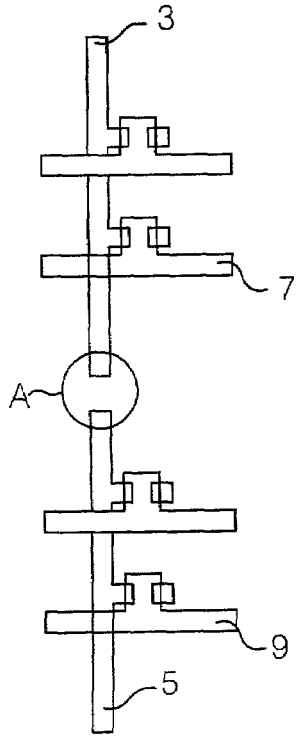
FIG.2 CONVENTIONAL ART
FIG. 2 is an enlarged plan view of the "A" portion in FIG. 1.
Figure 3:
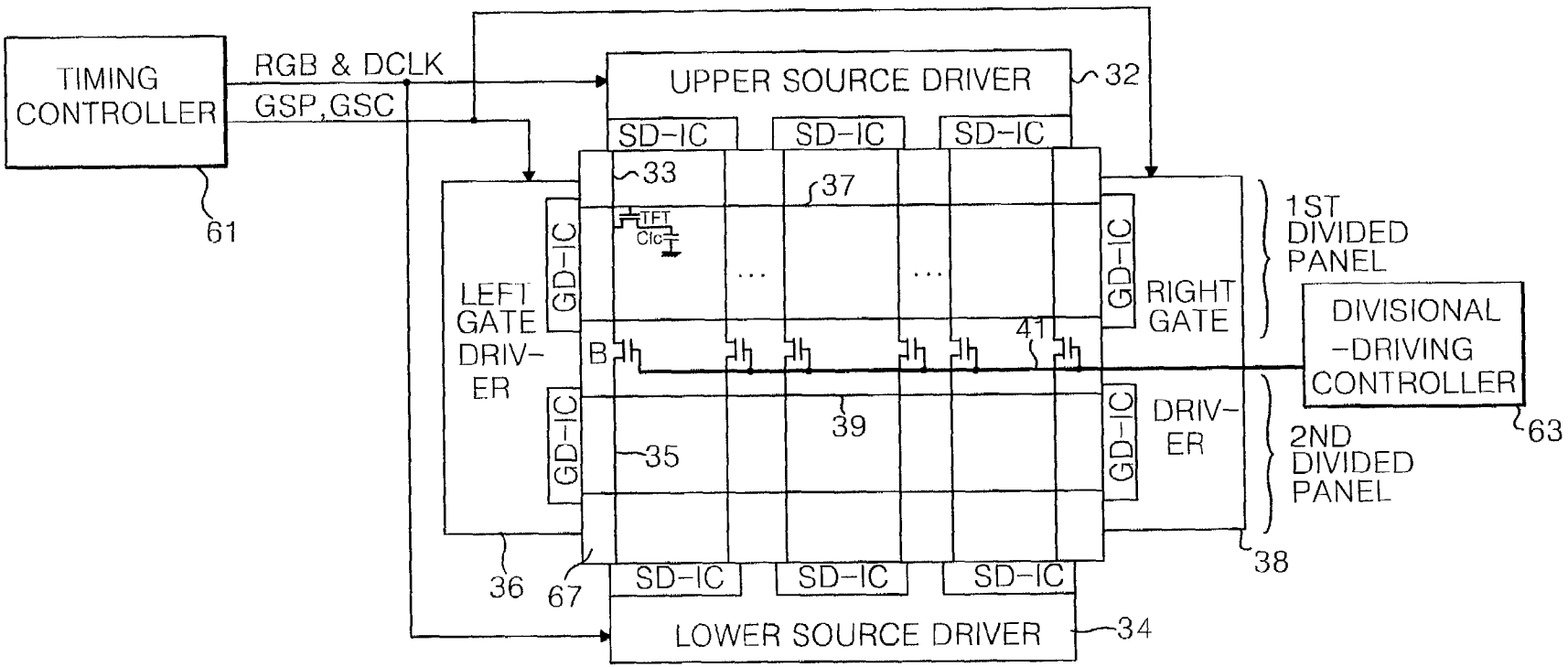
FIG. 3 is a block diagram showing a two-divisional driving scheme in a liquid crystal display according to a first embodiment of the present invention.

FIG. 3 illustrates a liquid crystal display (LCD) according to a first embodiment of the present invention.

The LCD in FIG. 3 includes a liquid crystal display panel 67 having a plurality of gate lines 37 and 39 and data lines 33 and 35 divided into the upper and lower sides that cross each other. TFT's are provided at the intersections therebetween to drive liquid crystal cells Clc. Upper and lower source drivers 32 and 34 apply data signals to the upper and lower data lines 33 and 35 of the liquid crystal display panel 67. Left and right gate drivers 36 and 38 apply scanning signals to the gate lines 37 and 39. A divisional driving switching device "B" provided at the divided point between the upper and lower data lines 33 and 35 to select a divisional driving mode and a non-divisional driving mode. A timing controller 61 is supplied with digital video data and horizontal and vertical synchronizing signals H and V. A divisional driving controller 53 applies a selection signal for one of the divisional driving mode and the non-divisional driving mode to the divisional driving switching device "B".

In the liquid crystal display panel 67, a liquid crystal is injected between two glass substrates, and the upper and lower gate lines 37 and 39 are provided on the lower glass substrate in such a manner to perpendicularly cross the data lines 33 and 35 divided into the upper side and the lower side.

The TFT's provided at the intersections between the data lines 33 and 35 and the gate lines 37 and 39 apply the data signals through the data lines 33 and 35 to the liquid crystal cells Clc in response to the scanning pulses. To this end, gate electrodes of the TFT's are connected to the gate lines 37 and 39 while source electrodes thereof are connected to the data lines 33 and 35. Drain electrodes of the TFT's are connected to the pixel electrodes of the liquid crystal cells Clc.

The timing controller 61 rearranges digital video data supplied from a digital video card (not shown). Red(R), green(G), and blue(B) data RGB rearranged by the timing controller 61 are applied to the upper and lower source drivers 32 and 34. Further, the timing controller 61 generates timing control signals, such as a dot clock DCLK, a gate start pulse GSP, a gate shift clock GSC and an output enable/disable signal, and a polarity control signal in accordance with the horizontal and vertical synchronizing signals H and V inputted thereto, thereby controlling the upper and lower source drivers 32 and 34 and the left and right gate drivers 36 and 38. The dot clock DCLK and the polarity control signal are applied to each of the upper and lower source drivers 32 and 34 while the gate start pulse GSP and the gate shift clock GSC are applied to each of the left and right gate drivers 36 and 38.

Each of the left and right gate drivers 36 and 38 includes a shift register for sequentially generating a scanning pulse, that is, a gate high pulse in response to the gate start pulse GSP and the gate shift clock GSC from the timing controller 61, and a level shifter for shifting a voltage of the scanning pulse into a level suitable for driving the liquid crystal cell Clc. The TFT is turned on in response to the scanning pulse.

Upon turning on the TFT, data signals on the upper and lower data lines 33 and 35 are applied to the pixel electrode of the liquid crystal cell Clc.

Each of the left and right gate drivers 36 and 38 is mounted with a plurality of gate drive IC's (GD-IC) for applying scanning signals to the gate lines 37 and 39 each having a block unit. Each of the GD-IC sequentially applies the scanning signal to the gate lines 37 and 39 connected thereto.

The left and right gate drivers 36 and 37 apply a bilateral scanning signal to the gate lines 37 and 39 of the first and second divided panels that are divided into the upper side and the lower side based on a signal only without a physical division. They are arranged at the left side and the right side of the liquid crystal display panel 67 so as to reduce a line resistance of the gate lines 37 and 39, and apply the scanning signals to the gate lines 37 and 39.

The upper and lower source drivers 32 and 34 are supplied with the red(R), green(G), and blue(B) data RGB, and receive the dot clock DCLK from the timing controller 61. The upper and lower source drivers 32 and 34 sample the R, G, and B data RGB in response to the dot clock DCLK, and then latch the sampled data line by line. The latched data are converted into analog data and simultaneously applied to the upper and lower data lines 33 and 35 at each scanning interval. The upper and lower source drivers 32 and 34 may supply gamma voltages according to data signals to the upper and lower data lines 33 and 35.

Each of the upper and lower source drivers 32 and 34 is mounted with a plurality of source drive IC's (SD-IC) for applying data signals to the data lines 33 and 35 each having a block unit. Each of the SD-IC sequentially applies a data signal to the data lines 33 and 35 connected thereto. In other words, the data signals from the upper source driver 32 are applied to the data lines 33 of the first divided panel positioned at the upper side of the liquid crystal display panel 67, whereas the data signals from the lower source driver 34 are applied to the data lines 35 of the second divided panel positioned at the lower side of the liquid crystal display panel 67.

Figure 4:
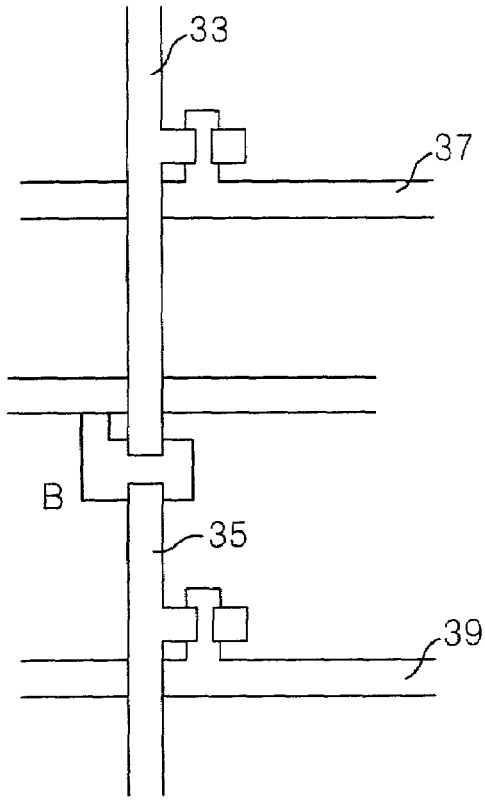
FIG. 4 is a plan view of the divisional driving switching device provided at the center of the data line in FIG. 3.

The divisional driving switching device "B" is arranged between the upper and lower data lines 33 and 35 divided, as shown in FIG. 4. The divisional driving switching device "B" switches a divisional driving mode and a non-divisional driving mode of the liquid crystal display panel 67 divided by the upper side and the lower side in accordance with a selection signal applied from the divisional driving controller 63. To this end, a gate electrode of the divisional driving switching device "B" is connected to a divisional driving control line 41 while a source electrode thereof is connected to the upper data line 33. A drain electrode of the divisional driving switching device "B" is connected to the lower data line 35.

Accordingly, the divisional driving switching device "B" allows the data signals supplied from the upper source driver 32 to the upper data lines 33 to be applied to the lower data lines 35 in response to a selection signal for a non-divisional driving mode of the liquid crystal display panel 67 from the divisional driving controller 63. Further, the upper data lines 33 and the lower data lines 35 are disconnected by the divisional driving switching device "B" in response to the selection signal for the divisional driving mode of the liquid crystal display panel 67 from the divisional driving controller 63. Thus, the upper data lines 33 receive data signals from the upper source driver 32 while the lower data lines 35 receive data signals from the lower source driver 34.

The divisional driving controller 63 applies an ON/OFF selection signal to the divisional driving switching device "B" by an externally selected ON/OFF signal. In other words, the liquid crystal display panel 67 is driven in a non-divisional driving mode for an on-selection signal, whereas it is driven in a divisional driving mode for an off-selection signal.

In the present LCD, the divisional driving switching device "B" is arranged at the center of the data line of the liquid crystal display panel and is subject to an external ON/OFF control, so that the liquid crystal display panel 67 can be driven in both the divisional driving mode and the non-divisional driving mode.

Figure 5:
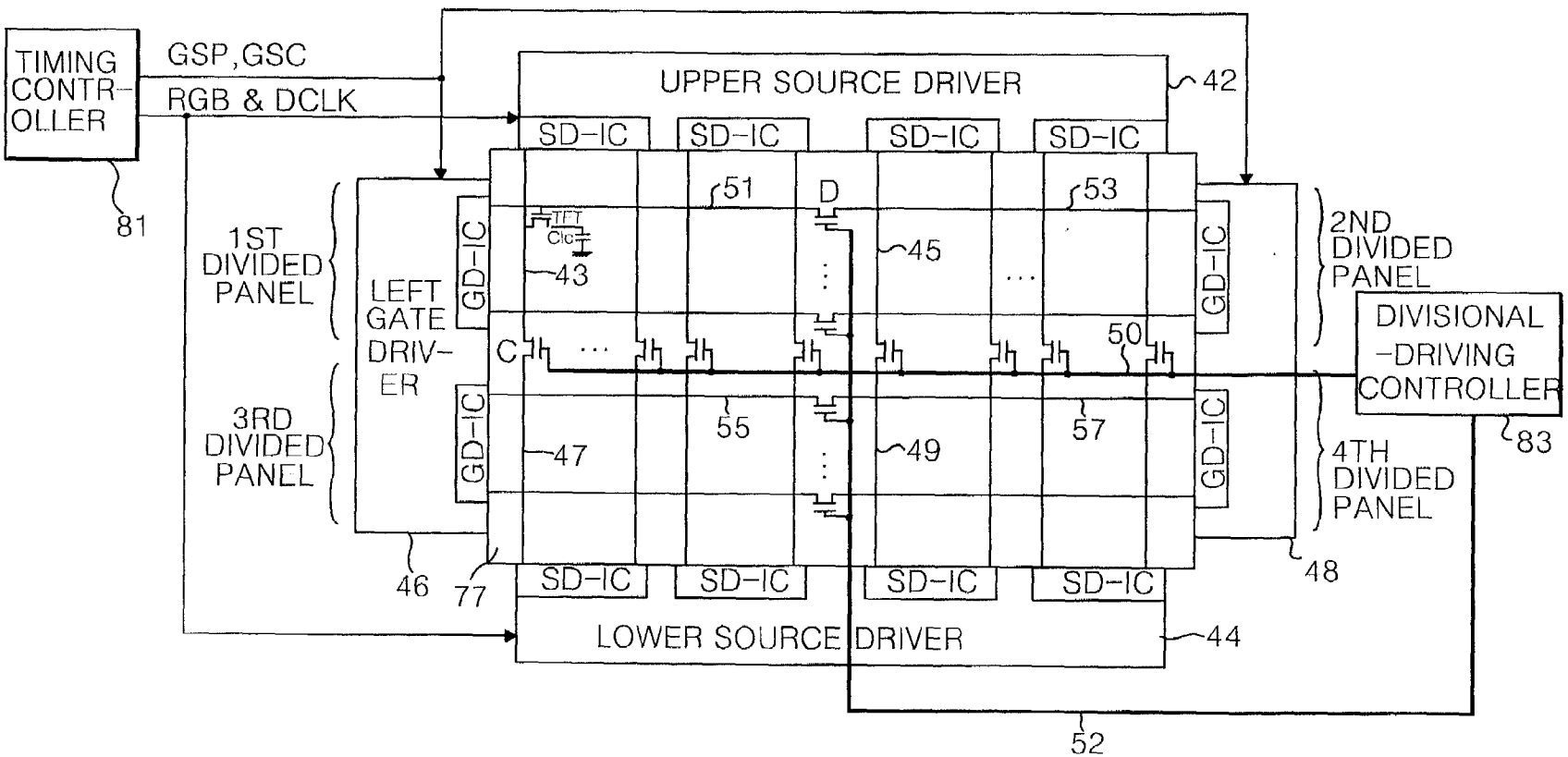
FIG. 5 is a block diagram showing a four-divisional driving scheme in a liquid crystal display according to a second embodiment of the present invention.

FIG. 5 illustrates a liquid crystal display (LCD) according to a second embodiment of the present invention.

The LCD in FIG. 5 includes a liquid crystal display panel 77 having four-divided gate lines 51, 53, 55, and 57 and four-divided data lines 43, 45, 47, and 49 that cross each other and TFT's provided at the intersections therebetween to drive liquid crystal cells Clc. Upper and lower source drivers 42 and 44 apply data signals to the upper data lines 43 and 45 and the lower data lines 47 and 49 of the liquid crystal display panel 77. Left and right gate drivers 46 and 48 apply scanning signals to the left gate lines 51 and 55 and the right gate lines 53 and 57. A first divisional driving switching device "C" provided at the middle portion of the upper data lines 43 and 45 and the lower data lines 47 and 49 selects a vertical divisional driving mode or a non-divisional driving mode. A second divisional driving switching device "D" provided at the middle portion of the left gate lines 51 and 55 and the right gate lines 53 and 57 selects a horizontal divisional driving mode or a non-divisional driving mode. A timing controller 81 is supplied with a digital video data and horizontal and vertical synchronizing signals H and V. A divisional driving controller 83 applies a selection signal for one of the vertical/horizontal divisional driving mode and the non-divisional driving mode to the first and second divisional driving switching devices "C" and "C".

In the liquid crystal display panel 77, a liquid crystal is injected between two glass substrates, and the gate lines 51, 53, 55, and 57 are provided on the lower glass substrate in such a manner to perpendicularly cross the data lines 43, 45, 47, and 49.

The TFT's provided at the intersections between the data lines 43, 45, 47, and 49 and the gate lines 51, 53, 55, and 57 apply data signals through the data lines 43, 45, 47, and 49 to the liquid crystal cells Clc in response to the scanning pulses.

To this end, gate electrodes of the TFT's are connected to the gate lines 51, 53, 55, and 57 while source electrodes thereof are connected to the data lines 43, 45, 47, and 49. Drain electrodes of the TFT's are connected to the pixel electrodes of the liquid crystal cells Clc.

The timing controller 81 rearranges digital video data supplied from a digital video card (not shown). Red(R), green(G), and blue(B) data RGB rearranged by the timing controller 81 are applied to the upper and lower source drivers 42 and 44. Further, the timing controller 81 generates timing control signals, such as a dot clock DCLK, a gate start pulse GSP, a gate shift clock GSC and an output enable/disable signal, and a polarity control signal in accordance with the horizontal and vertical synchronizing signals H and V inputted thereto, thereby controlling the upper and lower source drivers 42 and 44 and the left and right gate drivers 46 and 48. The dot clock DCLK and the polarity control signal are applied to each of the upper and lower source drivers 42 and 44 while the gate start pulse GSP and the gate shift clock GSC are applied to each of the left and right gate drivers 46 and 48.

Each of the left and right gate drivers 46 and 48 includes a shift register for sequentially generating a scanning pulse, that is, a gate high pulse in response to the gate start pulse GSP and the gate shift clock GSC from the timing controller 81, and a level shifter for shifting a voltage of the scanning pulse into a level suitable for driving the liquid crystal cell Clc. The TFT is turned on in response to the scanning pulse. Upon turning on the TFT, the data signals on the upper and lower data lines 43 and 45 are applied to the pixel electrode of the liquid crystal cell Clc.

Each of the left and right gate drivers 46 and 48 is mounted with a plurality of gate drive IC's (GD-IC) for applying scanning signals to the gate lines 51, 53, 55, and 57 each having a block unit. Each of the GD-IC sequentially applies the scanning signal to the gate lines 51, 53, 55, and 57 connected thereto.

The upper and lower source drivers 42 and 44 are supplied with the red(R), green(G), and blue(B) data RGB, and receive the dot clock DCLK from the timing controller 81. The upper and lower source drivers 42 and 44 sample the R, G, and B data RGB in response to the dot clock DCLK, and then latch the sampled data line by line. The latched data is converted into analog data and simultaneously applied to the upper data lines 43 and 45 and the lower data lines 47 and 49 at each scanning interval. The upper and lower source drivers 42 and 44 may apply gamma voltages according to data signals to the upper data lines 43 and 45 and the lower data lines 47 and 49.

Each of the upper and lower source drivers 42 and 44 is mounted with a plurality of source drive IC's (SD-IC) for applying data signals to the data lines 43, 45, 47, and 49 each having a block unit. Each of the SD-IC sequentially applies a data signal to the data lines 43, 45, 47, and 49 connected thereto.

In accordance with the left and right gate driver 46 and 48 and the upper and lower source drivers 42 and 44, the first divided panel positioned at the left upper side of the liquid crystal display panel 77 is driven by the upper source driver 42 and the left gate driver 46. The second divided panel positioned at the right upper side of the liquid crystal display panel 77 is driven by the upper source driver 42 and the right gate driver 48. The third divided panel positioned at the left lower side is driven by the lower source driver 44 and the left gate driver 46. The fourth divided panel positioned at the right upper side is driven by the lower source driver 42 and the right gate driver 48. The first divisional driving switching device "C" is arranged between the upper data lines 43 and 45 and the lower data lines 47 and 49, as shown in FIG. 4, whereas the second divisional driving switching device "D" is provided at the middle portion of the left gate lines 51 and 55 and the right gate lines 53 and 57, as shown in FIG. 6.

The first divisional driving switching device "C" switches a vertical divisional driving mode to a vertical non-divisional driving mode, and vice versa, of the liquid crystal display panel 77 divided into the upper side and the lower side in accordance with a selection signal applied from the divisional driving controller 83. To this end, a gate electrode of the first divisional driving switching device "C" is connected to a vertical divisional driving control line 50 while a source electrode thereof is connected to the upper data lines 43 and 45. A drain electrode of the first divisional driving switching device "C" is connected to the lower data lines 47 and 49.

Accordingly, the first divisional driving switching device "C" allows the data signals supplied from the upper source driver 42 to the upper data lines 43 and 45 to be applied to the lower data lines 47 and 49 in response to a selection signal for a vertical non-divisional driving mode of the liquid crystal display panel 77 from the divisional driving controller 83. Further, the first divisional driving switching device "C" electrically separates the upper data lines 43 and 45 from the lower data lines 47 and 49 in response to a selection signal for a vertical divisional driving mode of the liquid crystal display panel 77 from the divisional driving controller 83. Thus, the upper data lines 43 and 45 receive data signals from the upper source driver 42 while the lower data lines 47 and 49 receive data signals from the lower source driver 44.

Figure 6:
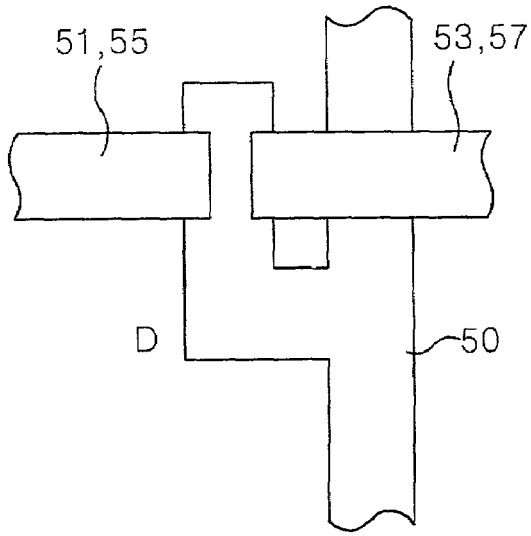
FIG. 6 is a plan view of the divisional driving switching device provided at the center of the data line in FIG. 5.

Referring to FIG. 6, the second divisional driving switching device "D" switches a horizontal divisional driving mode to a horizontal non-divisional driving mode, and vice versa, of the liquid crystal display panel 77 divided into the left side and the right side in accordance with a selection signal applied from the divisional driving controller 83. To this end, a gate electrode of the second divisional driving switching device "D" is connected to a horizontal divisional driving control line 52 while a source electrode thereof is connected to the left gate lines 51 and 55. A drain electrode of the second divisional driving switching device "D" is connected to the right gate lines 53 and 57.

Accordingly, the second divisional driving switching device "D" allows the data signals supplied from the left gate driver 46 to the left gate lines 51 and 55 to be applied to the right gate lines 53 and 57 in response to a selection signal for a horizontal non-divisional driving mode of the liquid crystal display panel 77 from the divisional driving controller 83. Further, the second divisional driving switching device "D" electrically separates the left gate lines 51 and 55 from the right gate lines 53 and 57 in response to a selection signal for a horizontal divisional driving mode of the liquid crystal display panel 77 from the divisional driving controller 83. Thus, the left gate lines 51 and 53 receive data signals from the left gate driver 46 while the right gate lines 53 and 57 receive data signals from the right gate driver 48.

The divisional driving controller 83 applies an ON/OFF selection signal to each of the first and second divisional driving switching devices "C" and "D" by an externally selected ON/OFF signal. In other words, the liquid crystal display panel 77 is driven in a non-divisional driving mode when all the selection signals applied to the first and second divisional driving switching devices "C" and "D" are an on-selection signal. On the other hand, the liquid crystal display panel 77 is driven in a divisional driving mode when all the selection signals applied to the liquid crystal display panel 77 are an off-selection signal. As a result, the liquid crystal display panel 77 is driven based on four-divisions in the vertical and horizontal directions.

In the mean time, when a selection signal applied to the first divisional driving switching device "C" is an ON signal and a selection signal applied to the second divisional driving switching device "D" is an OFF signal, the liquid crystal display panel 77 is driven based on two-divisions in the horizontal direction. On the other hand, when a selection signal applied to the first divisional driving switching device "C" is an OFF signal and a selection signal applied to the second divisional driving switching device "D" is an ON signal, the liquid crystal display panel 77 is driven based on two-divisions in the vertical direction.

In the present LCD, the liquid crystal display panel 77 is divided into four areas in the vertical and horizontal directions. The first and second divisional driving switching devices "C" and "D" provided at the middle portion of the divided data lines and the divided gate line are controlled. Thus, a four-divisional driving mode, a two-divisional driving mode, and a non-divisional driving mode are realized in the present invention. Accordingly, the same driving voltage is applied to the same line, so that a deterioration in picture quality between the upper and lower sides and the left and right sides of the liquid crystal display panel is prevented.

As described above, the thin film transistors in the present invention are further provided at the physically divided data lines, so that either a divisional driving mode or a non-divisional driving mode is selected based on a signal. Furthermore, the same driving voltage is applied to the signal lines by the divisional driving system, thereby solving a problem in picture quality caused by a signal line resistance in a large-scale/high-resolution LCD panel.

It will be apparent to those skilled in the art that various modifications and variations can be made in the liquid crystal display device of the present invention without departing from the spirit or scope of the inventions. Thus, it is intended that the present invention covers the modifications and variations of this invention provided they come within the scope of the appended claims and their equivalents.

What is claimed is:

1. A liquid crystal display device, comprising:

a liquid crystal display panel having a plurality of liquid crystal cells at each intersection between a plurality of data lines and gate lines and a plurality of thin film transistors driving the liquid crystal cells;

a plurality of first switching devices in the gate lines such that each gate line is provided with at least one of the plurality of first switching devices, the plurality of first switching devices being provided for switching a driving mode of the plurality of liquid crystal cells to either a divisional driving mode or a non-divisional driving mode, wherein the plurality of first switching devices are positioned at the middle portion of the gate lines;

a controller supplying a control signal to the first switching devices to control the first switching devices; and a control line connecting the first switching devices and the controller.

2. The liquid crystal display device of claim 1, further comprising a plurality of second switching devices at the middle portion of the data lines.

3. The liquid crystal display device of claim 1, wherein the control signal corresponds to an on-selection signal when the divisional driving mode is to be selected and corresponds to an off-selection signal when the non-divisional driving mode is to be selected.

4. A liquid crystal display device, comprising:

a liquid crystal display panel having a plurality of liquid crystal cells at each intersection between a plurality of data lines and gate lines and a plurality of thin film transistors driving the liquid crystal cells;

a plurality of first switching devices in the gate lines such that each gate line is provided with at least one of the plurality of first switching devices, the plurality of first switching devices being provided for switching a driving mode of the plurality of liquid crystal cells to either a divisional driving mode or a non-divisional driving mode, wherein the plurality of first switching devices are positioned at the middle portion of the gate lines;

a controller supplying a first control signal to the first switching devices to control the first switching devices;

a control line connecting the first switching devices and the controller;

first and second source drivers applying a data signal to the data lines;

first and second gate drivers applying a gate signal to the gate lines; and a timing controller applying a second control signal to the source driver and the gate driver.

5. The liquid crystal display device of claim 4, further comprising a plurality of second switching devices at the middle portion of the data lines.

6. The liquid crystal display device of claim 4, wherein the first control signal corresponds to an on-selection signal when the divisional driving mode is to be selected and corresponds to an off-selection signal when the non-divisional driving mode is to be selected.

* * * * *